US008491164B2

(12) United States Patent
Ford

(10) Patent No.: US 8,491,164 B2
(45) Date of Patent: Jul. 23, 2013

(54) LIGHT EMITTING DEVICE

(75) Inventor: Timothy D. F. Ford, Beaconsfield (CA)

(73) Assignee: The Flewelling Ford Family Trust, Beaconsfield (CA)

( * ) Notice: Subject to any disclaimer, the term of this patent is extended or adjusted under 35 U.S.C. 154(b) by 359 days.

(21) Appl. No.: 12/775,890

(22) Filed: May 7, 2010

(65) Prior Publication Data

US 2010/0284193 A1 Nov. 11, 2010

Related U.S. Application Data

(60) Provisional application No. 61/176,328, filed on May 7, 2009.

(51) Int. Cl.
*F21V 3/02* (2006.01)
*F21V 3/04* (2006.01)

(52) U.S. Cl.
USPC ..... 362/311.06; 362/311.01; 362/311.02; 362/311.09; 362/326; 362/335

(58) Field of Classification Search
USPC ..... 362/311.02, 311.06, 311.09, 326, 362/334, 335, 338
See application file for complete search history.

(56) References Cited

U.S. PATENT DOCUMENTS

| | | | | |
|---|---|---|---|---|
| 2,254,961 | A * | 9/1941 | Harris | 362/327 |
| 2007/0171641 | A1 * | 7/2007 | Sassoon | 362/244 |
| 2010/0195335 | A1 * | 8/2010 | Allen et al. | 362/309 |

* cited by examiner

*Primary Examiner* — Stephen F Husar
*Assistant Examiner* — James Cranson, Jr.
(74) *Attorney, Agent, or Firm* — Hugh Mansfield; Goudreau Gage Dubuc

(57) ABSTRACT

A light emitting device, method and lens, the device comprising an LED emitting a beam of light and a transparent light conditioning lens concentric with the beam of light and through which the beam of light travels. The lens comprises a light concentrating part and a light diffusing part. The concentrating part concentrates a first portion of the light to form a first beam of light having a narrow angle of dispersion, preferably of less than about 10 degrees and the light diffusing part diffuses a second portion of the light to form a second beam of light concentric with the first beam and having a wide angle of dispersion greater than the narrow angle of dispersion, preferably greater than about 70 degrees. An intensity of the first beam is greater than an intensity of the second beam.

19 Claims, 4 Drawing Sheets

LIGHT EMITTING DEVICE

CROSS REFERENCE TO RELATED APPLICATIONS

The present application claims benefit, under 35 U.S.C. §119(e), of U.S. provisional application Ser. No. 61/176,328, filed on May 7, 2009 which is incorporated herein in its entirety by reference.

FIELD OF THE INVENTION

The present invention relates to a light emitting device. In particular, the present invention relates to an assembly for conditioning light emitted from a light source in order to provide both a strong spot beam light and a diffuse light from the light source.

BACKGROUND OF THE INVENTION

The prior art reveals a number of signalling devices that emit either a concentrated spot beam of light, for example a conventional flashlight or the like, or a diffuse light, for example a reading light or the like.

In environments containing smoke or of high turbidity, much of the light from sources having a wide beam is reflected back towards the source whereas a strong beam penetrates the turbidity while producing some ambient glow through reflection off the particles. This acts well as a beacon as well as providing better penetration of vision into the turbid medium than would otherwise be possible with a wide beam. On the other hand, in smoke free conditions or conditions of low turbidity, a concentrated beam is poorly visible from the sides.

What is needed for use in all such situations, therefore, is a light emitting device that simultaneously emits a wide angle beam visible from the sides and a concentrated beam.

SUMMARY OF THE INVENTION

In order to address the above and other drawbacks there is disclosed a light emitting device comprising an LED emitting a beam of light and a transparent light conditioning lens concentric with the beam of light and through which the beam of light travels. The lens comprises a light concentrating part and a light diffusing part. The concentrating part concentrates a first portion of the light to form a first beam of light having a narrow angle of dispersion, preferably of less than about 10 degrees and the light diffusing part diffuses a second portion of the light to form a second beam of light concentric with the first beam and having a wide angle of dispersion greater than the narrow angle of dispersion, preferably greater than about 70 degrees. An intensity of the first beam is greater than an intensity of the second beam.

Additionally, there is also disclosed a method of providing illumination comprising providing an LED emitting light, concentrating a first portion of the light to form a first beam of light having a narrow angle of dispersion of preferably less than about 10 degrees, and diffusing a second portion of the light to form a second beam of light concentric with the first beam and having a wide angle of dispersion greater than the narrow angle of dispersion and preferably of greater than about 70 degrees. An intensity of the first beam is greater than an intensity of the second beam.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

Figure 1:
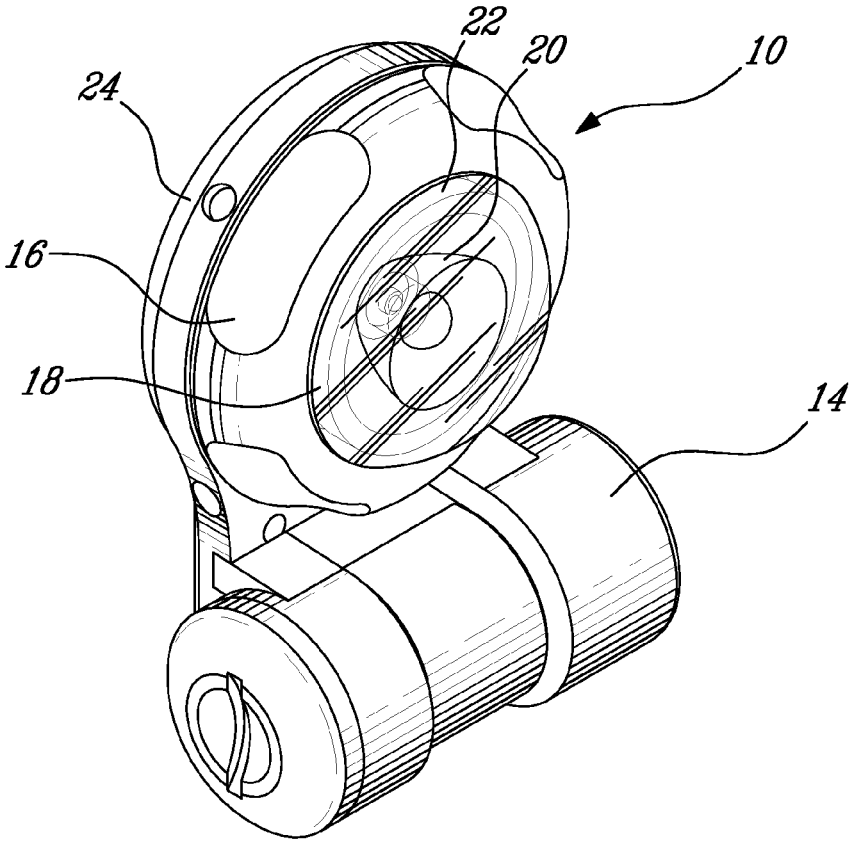
FIG. 1 provides a left raised perspective view of a light emitting device in accordance with an illustrative embodiment of the present invention.
Figure 2:
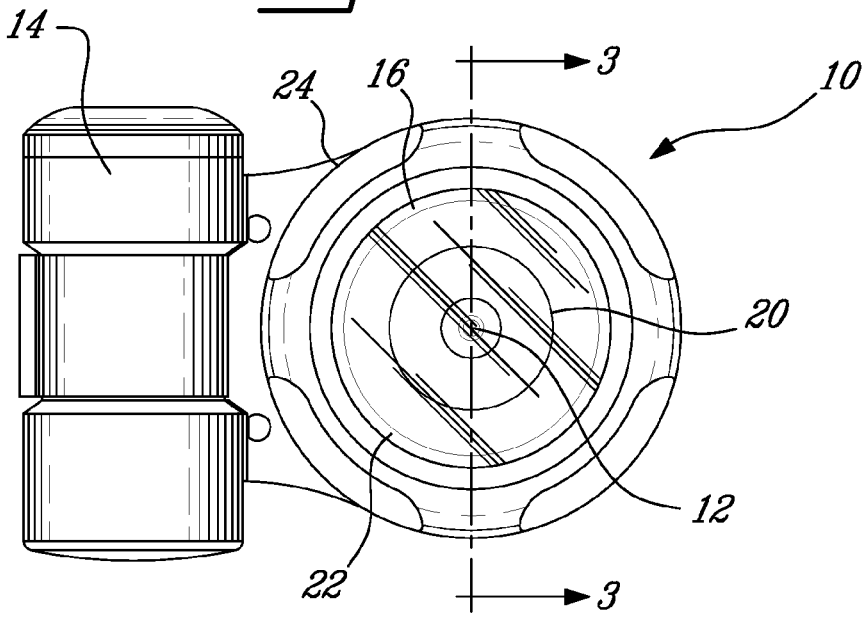
FIG. 2 provides a top plan view a light emitting device in accordance with an illustrative embodiment of the present invention.

Referring now to FIGS. 1 and 2, and in accordance with an illustrative embodiment of the present invention, a light emitting device, generally referred to using the reference numeral 10, will now be described. The device 10 comprises a light source 12 such as an LED under control of electronics (not shown) powered by a battery held in a battery compartment 14. A bezel mounted rotary switch 16 is provided to allow the requisite selective input control to the electronics, for example to select one of plurality of different signalling signatures, such as steady on, intermittent flashing or the maritime distress signal SOS. The LED 12 illustratively is supported on a reflective surface 18. A collimating/dispersing transparent light conditioning lens 20 manufactured from transparent glass, acrylic, polycarbonate or the like is secured to the reflective surface 18 immediately above the LED 12. Additionally, a lens cover 22 manufactured from transparent polycarbonate or the like serves the dual purpose of protecting the LED 12 and lens 20 from the outside elements as well as securing the rotary switch 16 to the body 24 of the device 10.

Figure 3A:
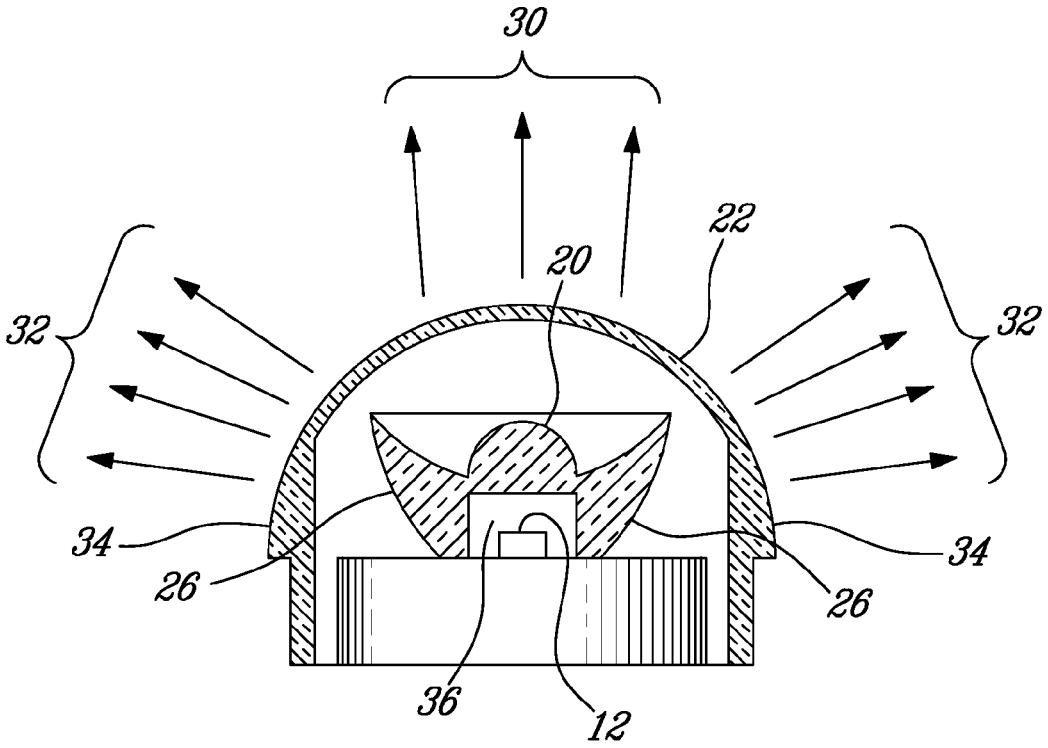
FIG. 3A provides a cutaway view along III-III of the light emitting device in FIG. 2.

Referring now to FIG. 3A, the lens 20 is of a Batwing style or the like known in the art and used on many conventional LED flashlights. The lens 20 is adapted to fit directly over the LED 12, which is illustratively a low profile surface mounted device with a generally flat emitting surface. Typically the peripheral edges 26 of such a lens are silvered such that substantially all the light emitted by the LED 12 is efficiently propagated forward and exits the lens 20 in a direction concentric with the LED. However, in an illustrative embodiment of the present invention the silvering is absent thus allowing a portion of the light emitted by the LED to escape via the sides of the lens 20.

Figure 4A:
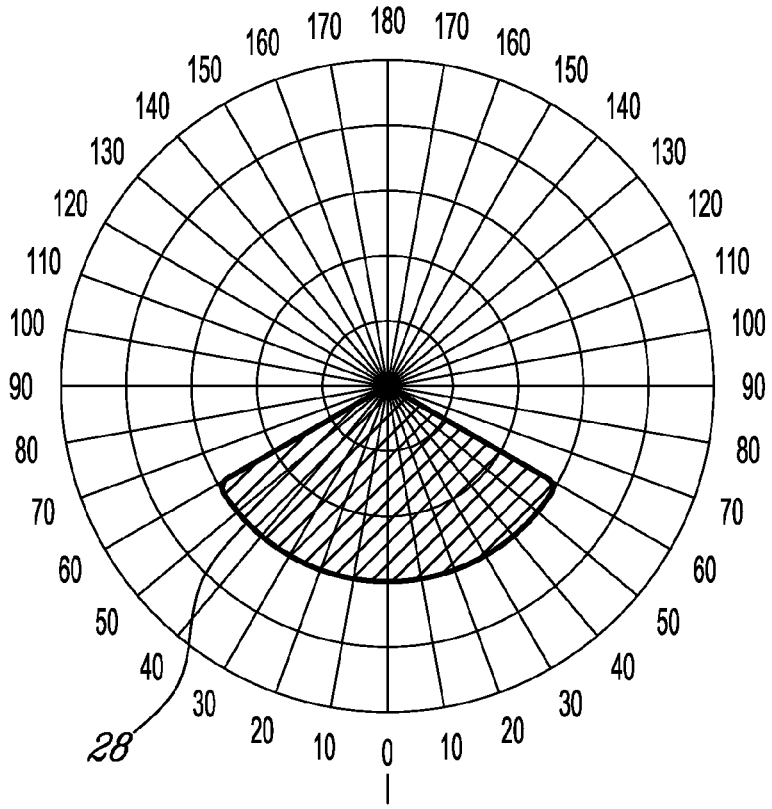
Fig. 4A PRIOR ART
FIG. 4A is a polar plot of the intensity of a conventional high power LED.
Figure 4B:
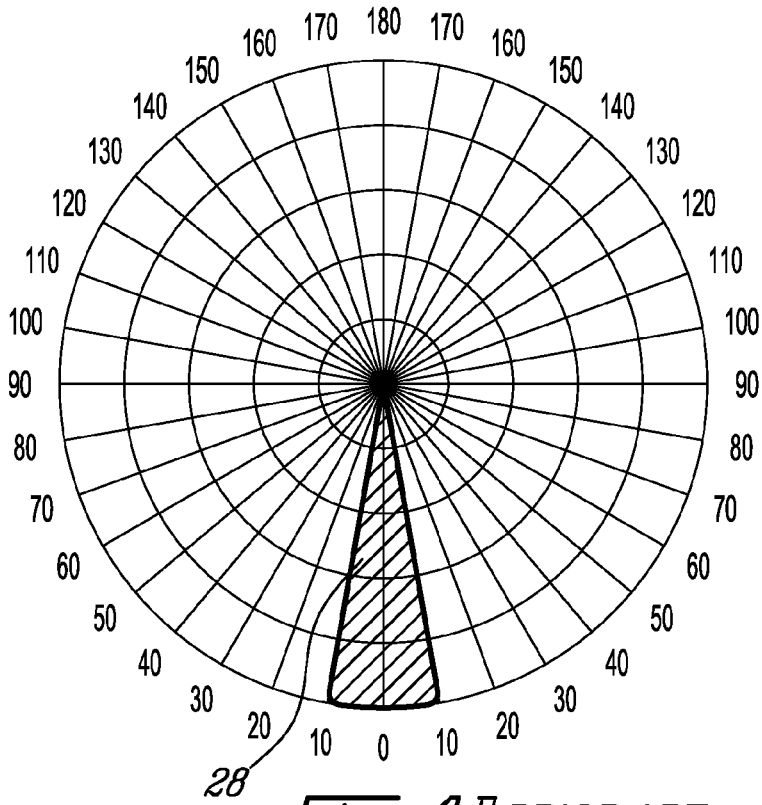
Fig. 4B PRIOR ART
FIG. 4B is a polar plot of the intensity of a conventional high power LED combined with a collimating lens assembly.

Referring now to FIG. 4A, prior art LEDs typically emit relatively constant light with an angle of dispersion 28 of about 60° about a central axis of the LED. The prior art also discloses the use of a silvered Batwing type lens or the like to collimate the light such that the angle of dispersion 28 is of about 10° about a central axis of the LED.

Figure 4C:
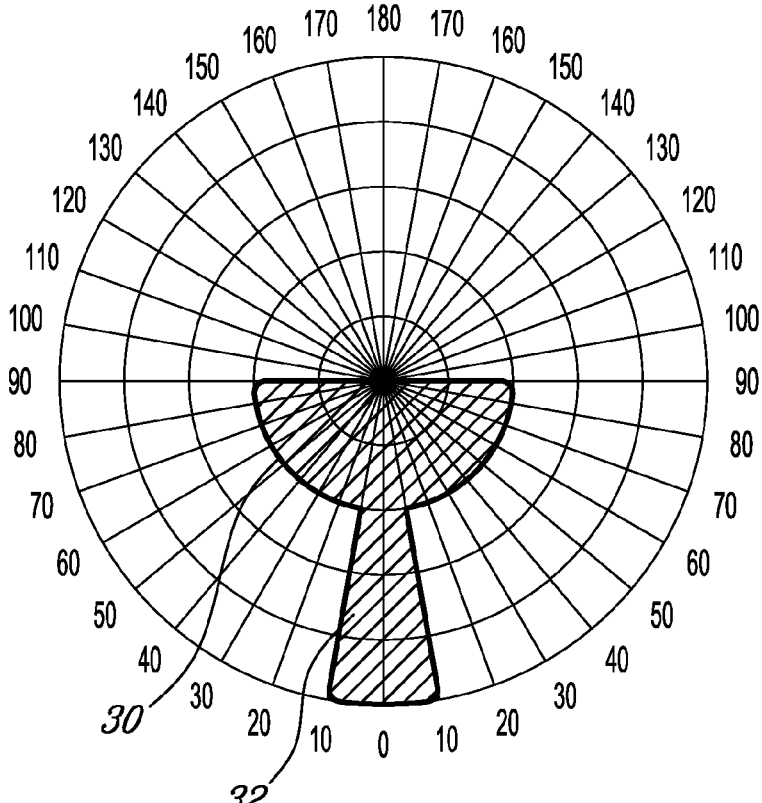
FIG. 4C is a polar plot of the intensity of a conventional high power LED combined with a collimating and dispersing lens assembly in accordance with an illustrative embodiment of the present invention.

Referring back to FIG. 3A together with FIG. 4C, in operation, the LED 12 emits light a first portion of which is collimated by the lens 20 to form a relatively intense spot beam of concentrated light 30 having an angle of dispersion of about 10° about a central axis of the LED and a second portion of which is dispersed by the lens 20 to form a less intense diffuse ambient light 32 having an angle of dispersion of about 70° about a central axis of the LED and concentric with the beam of concentrated light 30. Additionally, the relatively thick annular shoulder section 34 about a periphery of the transparent lens cover 22 serves to intensify light propagating through it, thereby producing a distinguishable ring signature of somewhat more intense light around the base of the lens cover 22.

Still referring to FIG. 3A and FIG. 4C, a person of skill in the art will understand that the light dispersion resulting from the combination of the lens 20 and the LED 12 can be modified through variation of the shape of the lens 20. Indeed, known batwing type lenses, for example, come in a variety of forms offering varying focus, such that a spot beam 30 having a different angle of dispersion can be achieved through appropriate selection of the lens 20. In this regard, an elongate batwing style lens will typically produce more focus and less dispersion while a wider batwing style lens will typically produce more dispersion and less focus. Additionally, the dispersion of the light can be affected according to the positioning of the LED 12 relative to the lens 20. For example, positioning the LED 12 farther within the lens cavity 36 would typically lead to a higher percentage of the available light being dispersed, and vice-versa.

Figure 3B:
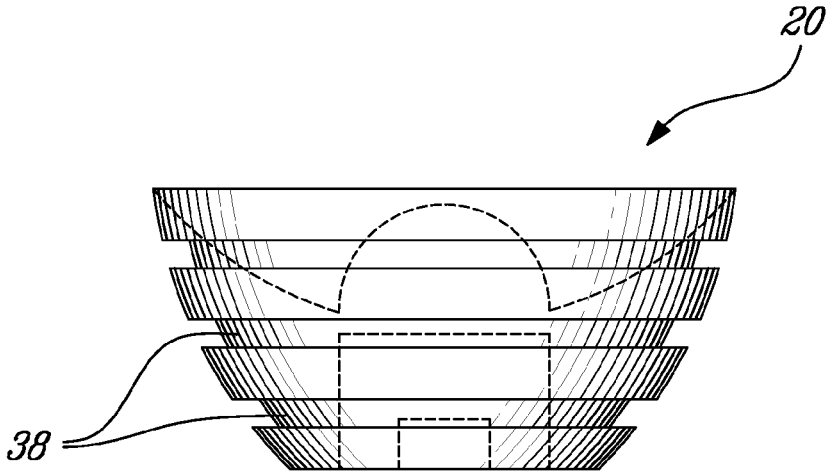
FIG. 3B provides a side plan view of a batwing type lens including horizontal striations in accordance with an illustrative embodiment of the present invention.
Figure 3C:
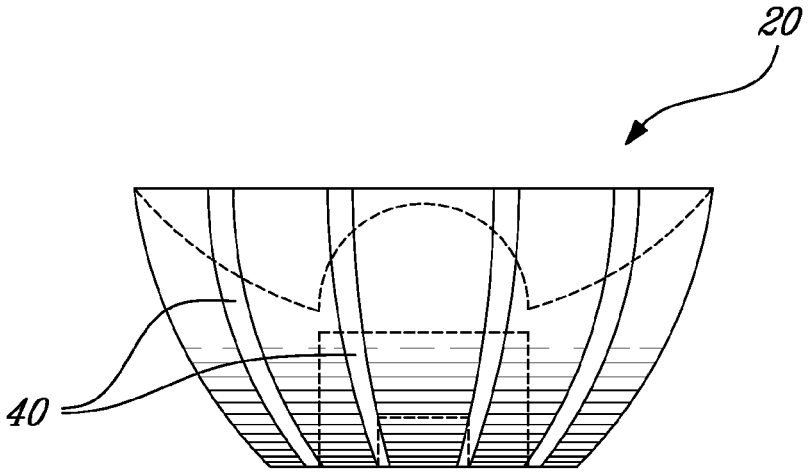
FIG. 3C provides a side plan view of a batwing type lens including vertical striations in accordance with an illustrative embodiment of the present invention.

Referring to FIG. 3B and FIG. 3C, in a particular embodiment the outer surface of the lens 20 can be machined, moulded or otherwise formed to include a plurality of respectively horizontal striations 38 (that is, oriented perpendicular to a central axis of the lens 20) or vertical striations 40 (that is, oriented in-line with a central axis of the lens 20). The striations can be either grooves or raised ridges. The striations 38, 40 aid in light dispersion by introducing surfaces which modify the path followed by light emitted by the LED 12.

Although the present invention has been described hereinabove by way of specific embodiments thereof, it can be modified, without departing from the spirit and nature of the subject invention as defined in the appended claims.

What is claimed is:

1. A light emitting device comprising:

an LED emitting a beam of light; and a transparent light conditioning lens concentric with said beam of light and through which said beam of light travels, said lens consisting essentially of a light concentrating part and a light diffusing part;

wherein said concentrating part concentrates a first portion of said light to form a first beam of light having a narrow angle of dispersion and said light diffusing part diffuses a second portion of said light to form a second beam of light concentric with said first beam and having a wide angle of dispersion greater than said narrow angle of dispersion and further wherein an intensity of said first beam is greater than an intensity of said second beam.

2. The light emitting device of claim 1, wherein said light conditioning lens is a convex bowl-shaped batwing style lens.

3. The light emitting device of claim 1, wherein said narrow angle of dispersion is less than about 10 degrees.

4. The light emitting device of claim 1, wherein said wide angle of dispersion is greater than about 70 degrees.

5. The light emitting device of claim 1, further comprising a rotary switch rotatable about an axis concentric with said beam of light and wherein one of a plurality of different modes of operation can be selected by rotating said rotary switch.

6. The light emitting device of claim 1, wherein said transparent light conditioning lens comprises a plurality of horizontal striations on an outer surface thereof.

7. The light emitting device of claim 1, wherein said transparent light conditioning lens comprises a plurality of vertical striations on an outer surface thereof.

8. The light emitting device of claim 1, further comprising a convex lens cover covering said lens, said lens cover comprising a light intensifying annular shoulder around a periphery thereof.

9. A method of providing illumination consisting essentially of:

providing an LED emitting light;

concentrating a first portion of said light to form a first beam of light having a narrow angle of dispersion; and diffusing a second portion of said light to form a second beam of light concentric with said first beam and having a wide angle of dispersion greater than said narrow angle of dispersion;

wherein an intensity of said first beam is greater than an intensity of said second beam.

10. The illumination method of claim 9, wherein said light conditioning lens is a convex bowl-shaped batwing style lens.

11. The illumination method of claim 9, wherein said narrow angle of dispersion is less than about 10 degrees.

12. The illumination method of claim 9, wherein said wide angle of dispersion is greater than about 70 degrees.

13. The illumination method of claim 9, further comprising providing a rotary switch rotatable about an axis concentric with said beam of light and selecting one of a plurality of different modes of operation by rotating said rotary switch about said axis.

14. A light conditioning lens for use together with an LED, the lens comprising:

a solid transparent lens body symmetrical about an axis, said body comprising a convex bowl shaped outer surface and an LED receiving cavity formed in a lower end thereof, said outer surface and said cavity concentric with said axis;

wherein said outer surface comprises a plurality of light dispersing striations.

15. The light conditioning lens of claim 14, wherein said lens body is fabricated from polycarbonate.

16. The light conditioning lens of claim 14, wherein said light dispersing striations are oriented perpendicular to said axis.

17. The light conditioning lens of claim 16, wherein said light dispersing striations are evenly spaced.

18. The light conditioning lens of claim 14, wherein said light dispersing striations are evenly spaced and oriented in line with said axis.

19. The light conditioning lens of claim 14, wherein said lens is a batwing style lens.

* * * * *